United States Patent [19]

Ashizaki et al.

[11] Patent Number: 4,831,309

[45] Date of Patent: May 16, 1989

[54] CATHODE RAY TUBE APPARATUS

[75] Inventors: Shigeya Ashizaki, Takatsuki; Osamu Konosu; Hiroshi Suzuki, both of Nagaokakyo; Masao Natsuhara, Otsu, all of Japan

[73] Assignee: Matsushita Electronics Corporation, Kadoma, Japan

[21] Appl. No.: 559,240

[22] Filed: Dec. 8, 1983

[30] Foreign Application Priority Data

Dec. 16, 1982 [JP] Japan ..... 57-221256

[51] Int. Cl.[4] ..... H01J 29/48

[52] U.S. Cl. ..... 313/413

[58] Field of Search ..... 313/413, 414, 447

[56] References Cited

U.S. PATENT DOCUMENTS

| | | | |
|---|---|---|---|
| 3,984,723 | 10/1976 | Gross et al. | 313/413 X |
| 4,242,613 | 12/1980 | Brambring et al. | 313/447 |
| 4,251,747 | 2/1981 | Burdick | 313/414 X |
| 4,443,736 | 4/1984 | Chen | 313/414 |
| 4,473,775 | 9/1984 | Hosokoshi et al. | 313/414 X |

*Primary Examiner*—David K. Moore
*Assistant Examiner*—Sandra L. O'Shea
*Attorney, Agent, or Firm*—Cushman, Darby & Cushman

[57] ABSTRACT

An in-line type cathode ray tube apparatus, is improved to obtain less aberration of beam spots by shaping the electron beam passing apertures (15*a,* 15*b,* 15*c*) in the control grid (11) and those in the accelerating grid (12) into horizontally oblong elliptic shapes, and providing a horizontally oblong electrode means (18) having a rectangle shape active space on the accelerating grid (12) at its down stream side of the electron beam.

5 Claims, 4 Drawing Sheets

CATHODE RAY TUBE APPARATUS

BACKGROUND OF THE INVENTION

1. Field of the Invention:

The present invention relates generally to an improvement in a cathode ray tube apparatus and more particularly to a cathode ray tube apparatus wherein high resolution is obtainable on all the parts of the phosphor screen.

2. Description of the Prior Art:

Generally, resolution of a cathode ray tube apparatus depends on the size and shape of beam spots produced on phosphor screen, and it is important to obtain beam spots having as small size and distortion as possible in order to obtain the high resolution. Furthermore, in a color cathode ray tube apparatus an important factor for the high resolution is that three beam spots made by three electron beams are concentrated on same position on the phosphor screen. Accordingly, in a color cathode ray tube apparatus of in-line type, magnetic field of the horizontal deflection member is designed to have a pin-cushion shaped distribution of magnetic flux as shown in FIG. 1(*a*) and magnetic field of a vertical deflection member has a barrel shape distribution of magnetic flux as shown in FIG. 1(*b*), thereby to achieve self-convergence of three electron beams 1, 2 and 3.

However, the above-mentioned way of the self-convergence has a problem that,though the convergence of three electron beams is improved, cross sections of three electron beams become distorted as the beam deflection angles increase. Therefore the beam spots produced at corner areas on the phosphor screen is liable to have distortions as shown in FIG. 2. That is, though the beam spot 5 produced at the center part of the phosphor screen 4 becomes circular, the beam spots 6 produced at the corner parts and peripheral parts are formed in a shape to include vertically oblong low brightness haze part 8, resulting in difficulty of achieving high resolution at the peripheral parts of the phosphor screen.

The above-mentioned shape distortion of the beam spots are induced by the application of non-uniform magnetic field of the deflection member as shown in FIG. 1(*a*) and FIG. 1(*b*) to the three electron beam set of the self-convergence type cathode ray tube apparatus, and deflection aberration of electron beams in the deflection magnetic field is produced as a result of strengthening of focusing in vertical direction.

SUMMARY OF THE INVENTION

The purpose of the present invention is to eliminate the above-mentioned conventional shortcoming and provide an improved cathode ray tube apparatus wherein satisfactory resolution is obtainable on all the areas of the phosphor screen.

The feature of the invention is to form the aperture for electron beam passing of the control grid in horizontally oblong shape, and provide an additional electrode of horizontally oblong shape having a rectangle active space therein on an accelerating grid at the downstream side of the accelerating grid.

That is, a cathode ray apparatus in accordance with the present invention comprises:

cathodes, a control grid, an accelerating grid, a focusing grid, an anode, a phosphor screen, an evacuated enclosure enclosing the above-mentioned components to form a cathode ray tube and a magnetic deflection means for producing a non-uniform deflection magnetic field, wherein the control grid has horizontally oblong apertures for passing electron beams from the cathodes, the accelerating grid has apertures of horizontally oblong or round shape for passing the electron beams, and also has, on the side to face the focusing grid, a horizontally oblong electrode means having a rectangle shape active space.

BRIEF DESCRIPTION OF THE DRAWING

FIG. 1(*b*) is a schematic view showing a relation between three electron beams and vertical deflection magnetic field having barrel shape distribution of magnetic flux.

FIG. 5(*b*) is a schematical elevation view of electron gun part showing operation of the focusing in the vertical direction.

FIG. 5(*c*) is a schematical view showing shapes and sizes of section of electron beams at various parts of the electron gun shown in FIG. 5(*a*) and FIG. 5(*b*).

DESCRIPTION OF THE PREFERRED EMBODIMENTS

Figure 3:
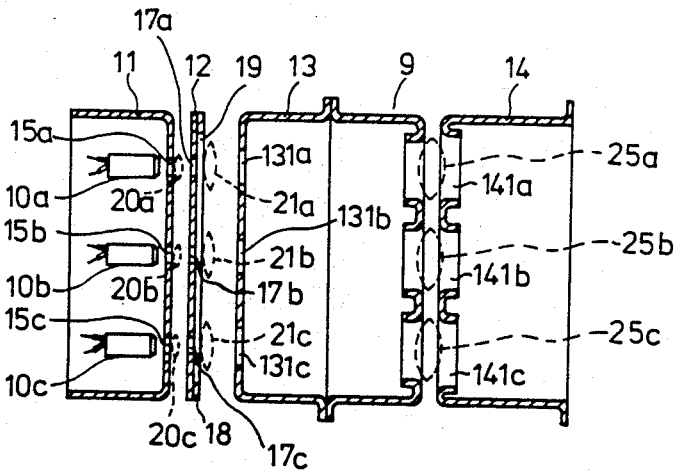
FIG. 3 is a sectional plan view of an electron gun part of an in-line type color cathode ray tube apparatus.
Figure 4:
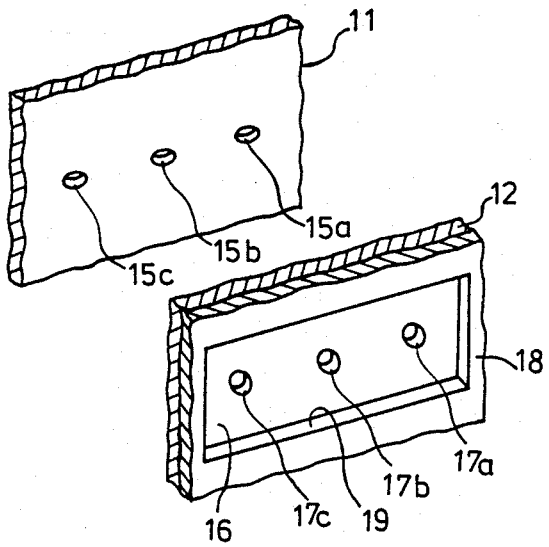
FIG. 4 is a fragmental perspective view of an essential part of the electron gun shown in FIG. 3.
Figure 6:
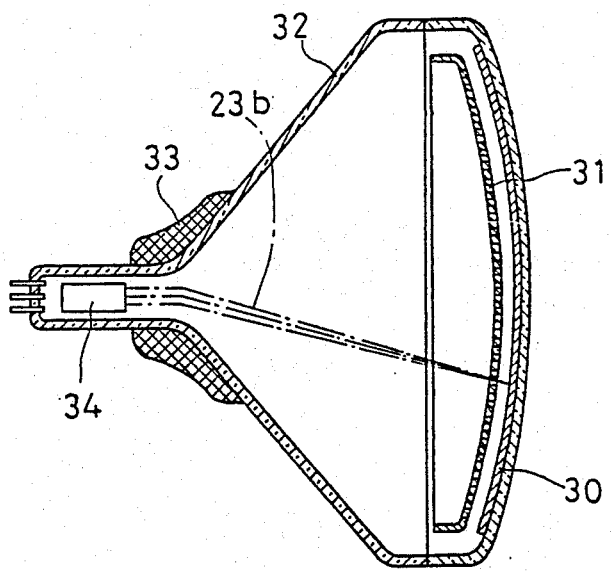
FIG. 6 is a sectional view showing a chathode ray tube.

As shown in FIG. 3 and FIG. 6, an electron gun part of the cathode ray tube apparatus embodying the present invention comprises three cathodes 10*a*, 10*b* and 10*c* which are disposed in-line in a horizontal plane, a control grid 11 having three apertures 15*a*, 15*b* and 15*c*, an accelerating grid 12 having three apertures 17*a*, 17*b* and 17*c*, a focusing grid 13 having apertures 131*a*, 131*b* and 131*c*, and an anode 14 having three apertures 141*a*, 141*b* and 141*c*. The apertures 15*a*, 15*b* and 15*c* on the control grid 11 are shaped in horizontally oblong ellipse. The apertures 17*a*, 17*b* and 17*c* are shaped in circles or horizontally oblong ellipses. The accelerating grid 12 has additional oblong electrode 18 which has horizontally oblong large aperture 19 in a manner that the apertures 17*a*, 17*b* and 17*c* are facing in a rectangle shape active space formed in the horizontally oblong electrode means 18.

Figure 1A:
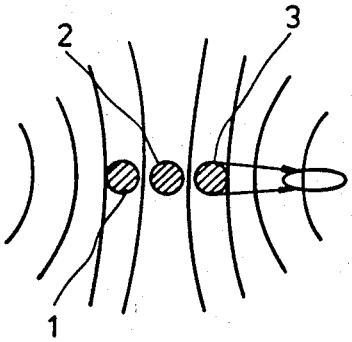
FIG. 1(*a*) is a schematic view showing a relation between three electron beams and horizontal deflection magnetic field having pin-cushion shape distribution of magnetic flux.
Figure 1B:
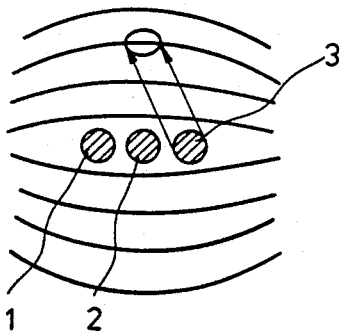
Figure 2:
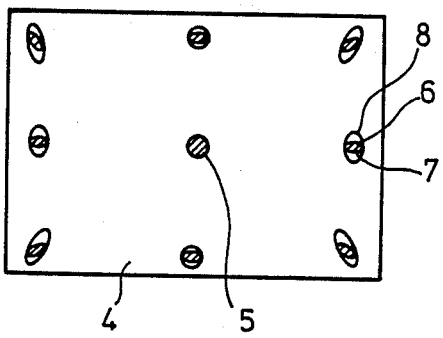
FIG. 2 is a schematical front view of phosphor screen showing shape distortion of the beam spots at various parts on the phosphor screen.

The color cathode ray tube having the above-mentioned electron gun 34 of a known bi-potential type electrode configuration is operated by providing a magnetic deflection means 33, which has a non-uniform deflection magnetic field shown by FIG. 1(*a*) illustrating magnetic flux for horizontal deflection, and by FIG. 1(*b*) illustrating magnetic flux for vertical deflection, and under similar conditions of operating voltages as those of the conventional cathode ray tube apparatus. In the operation, as schematically shown by dotted lines in FIG. 3, three local electric field lenses 20*a*, 20*b* and 20*c* are formed between the control grid 11 and the accelerating grid 12. Three pre-focus lenses 21*a*, 21*b* and 21*c* are formed between the accelerating grid and the focusing grid 13, and these electric field lenses provide axially assymmetric lens function to respective electron beams. The operation of the embodiment is described with reference to FIG. 5(*a*), FIG. 5(*b*) and FIG. 5(*c*) by taking the central electron beam as an example.

Figure 5:
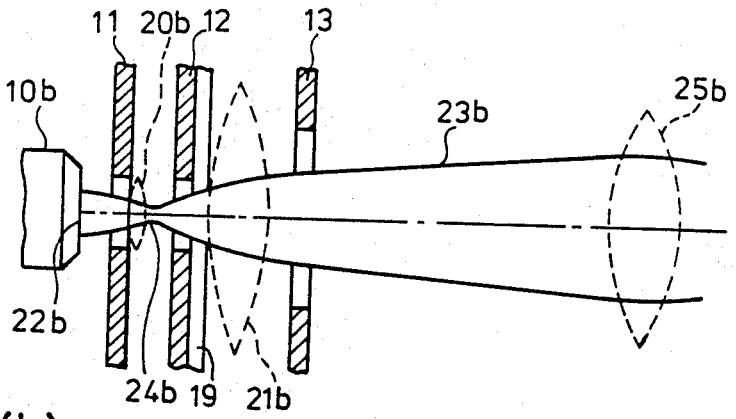
FIG. 5(*a*) is a schematical plan view of electron gun part showing operation of the focusing in the horizontal direction.
Figure 5:
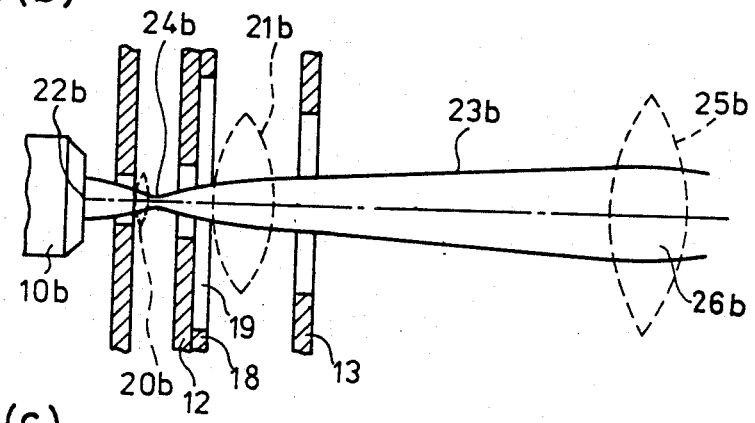
Figure 5:
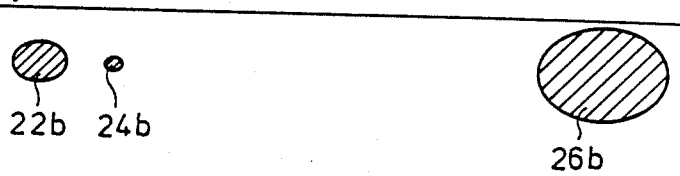

That is, the beam passing apertures 15*a*, 15*b* and 15*c* of the control grid 11 are formed in horizontally oblong ellipse shape as shown by FIG. 5(*a*), which schematically shows focusing of the electron beam in plan view aspect, and FIG. 5(*b*), which shows focusing electron beam in sectional elevation view aspect, and FIG. 5(*c*), which shows cross-sectional shape of electron beams at three parts, namely at cathode surface 20*b*, crossover 24*b* and deflection part 26*b* of FIG. 5(*a*) and FIG. 5(*b*). Accordingly, the substantial electron emitting area of the cathode 10*b* becomes horizontally oblong elliptic shape, and the shape of the electron beam 23*b* at the crossover point 24*b* becomes also horizontally oblong elliptic shape. The electron beam 23*b* which has passed through the crossover 24*b* is pre-focused by the prefocusing lens 21*b*, and at that time, by means of the oblong electrode means 18 having horizontally rectangle shape active space attached on the side facing to the focusing grid 13, the focusing function is weaker in the horizontal direction than in the vertical direction. As a result,-the cross-section 26*b* shown in FIG. 5(*c*) at the part of the main focusing lens 25*b* becomes horizontally oblong elliptic shape, and the electron beam 23*b* focused by the main focusing lens 25*b* enters in the non-uniform deflection magnetic field. The same applies for other electron beams from the cathode 10*a* and 10*c* which are prefocused by the prefocusing lens 20*a* and 20*c*, and substantially focused by the main focusing lens 25*a* and 25*c*, respectively.

Generally, self-convergence type deflecting magnetic field provides stronger focusing function for the electron beam specially in vertical direction than the horizontal direction when the beams are strongly deflected, thus, causing larger aberration in the vertical direction. In the present invention, by preforming the cross-section of the electron beam which is to enter in the deflecting magnetic field in horizontally oblong elliptic shape, resultant deflected electron beams have nearly circular cross-section, having less haze in the vertical direction. Thereby, aberration in the deflection, decreases to provide beam spots of satisfactory shape even at peripheral and corner parts of the phosphor screen 30.

The pre-focusing lenses 21*a*, 21*b* and 21*c* provide weaker focusing function in horizontal direction and stronger focusing function in vertical direction to the electron beams. Therefore,lens magnitude of composite lens consisting of the pre-focusing lens and the main focusing lens become also smaller in horizontal direction and larger in vertical direction. On the other hand, the shape of the beam cross-section at the crossover is horizontally oblong ellipse. Accordingly, even at the central part of the phosphor screen 30, beam spots of substantially circular shape are obtainable.

Figure 7:
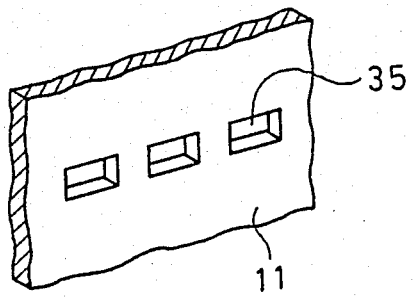
FIG. 7 is a perspective view showing a control grid having rectangle aperture.

In the above-mentioned embodiment, the electron beam passing apertures are shaped horizontally oblong elliptic shape. However, these apertures may be horizontally oblong rectangle shape as shown in FIG. 7 or horizontally oblong oval shape, or the like horizontally oblong shapes.

Since the present invention can correct the shape distortion of the beam spots of electron beam which is deflected in non-uniform deflecting magnetic field, the invention may be applicable not only for the above-mentioned example of in-line type color cathode ray tube apparatus, but also for single beam cathode ray tube apparatus or for plural-beam cathode ray tube apparatus in the similar way.

The present invention is industrially useful in providing beam spot on all parts of phosphor screen 30 with good uniformity of substantially circular shape without distortion, thereby enabling reproduction of clear image on the phosphor screen 30.

What is claimed is

1. A cathode ray tube apparatus comprising
cathodes,
a control grid,
an accelerating grid,
a focusing grid,
an anode,
a phosphor screen,
an evacuated enclosure enclosing the above-mentioned components to form a cathode ray tube and
a magnetic deflection means for producing a non-uniform deflection magnetic field,
wherein
said control grid has horizontally oblong apertures for passing electron beams from said cathodes,
said accelerating grid has apertures selected from the group consisting of horizontally oblong and round shape for passing said electron beams, and also has, on the side to face said focusing grid, a horizontally oblong electrode means having a rectangle shape active space,
said horizontally oblong electrode means having the same voltage as that of said accelerating grid.

2. A cathode ray tube apparatus in accordance with claim 1, wherein
said cathode ray tube is of an in-line type.

3. A cathode ray tube apparatus in accordance with claim 1, wherein
said non-uniform magnetic field comprises
a horizontal deflection magnetic field having a pincushion type magnetic flux distribution and
a vertical deflection magnetic field having a barrel type magnetic flux distortion.

4. A cathode ray tube apparatus in accordance with claim 1, wherein
said apertures on said control electrode is of ellipse.

5. A cathode ray tube apparatus in accordance with claim 1, wherein
said apertures on said control electrode is of rectangle.

* * * * *